US011732518B2

(12) United States Patent
Azevedo et al.

(10) Patent No.: US 11,732,518 B2
(45) **Date of Patent: *Aug. 22, 2023**

(54) DOOR ALIGNMENT MECHANISM

(71) Applicant: WHIRLPOOL CORPORATION, Benton Harbor, MI (US)

(72) Inventors: Alexandre C. Azevedo, St. Joseph, MI (US); Dakota E. Kosek, Benton Harbor, MI (US); Juan Pablo Ramirez Carrillo, South Bend, IN (US); Chad J. Rotter, Saugatuck, MI (US); Antonio Sanchez, Stevensville, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/671,209

(22) Filed: Feb. 14, 2022

(65) Prior Publication Data

US 2022/0162895 A1 May 26, 2022

Related U.S. Application Data

(62) Division of application No. 16/175,049, filed on Oct. 30, 2018, now Pat. No. 11,248,407.

(51) Int. Cl.
*E05F 7/00* (2006.01)
*F25D 23/02* (2006.01)

(52) U.S. Cl.
CPC ..... *E05F 7/005* (2013.01); *E05Y 2900/31* (2013.01); *F25D 23/028* (2013.01); *F25D 2323/021* (2013.01); *F25D 2323/024* (2013.01); *F25D 2400/18* (2013.01); *F25D 2500/02* (2013.01)

(58) Field of Classification Search
CPC ..... F25D 2323/021; F25D 2323/024; F25D 23/028; F25D 2500/02; E05F 7/005
See application file for complete search history.

(56) References Cited

U.S. PATENT DOCUMENTS 3,006,708 A 10/1961 Saunders et al.
3,157,306 A 11/1964 Courson
3,452,387 A 7/1969 Jerila et al.
(Continued)

FOREIGN PATENT DOCUMENTS

DE 102007058690 A1 6/2009
EP 2730866 A2 5/2014
(Continued)

*Primary Examiner* — Gregory J Strimbu
(74) *Attorney, Agent, or Firm* — Price Heneveld LLP

(57) ABSTRACT

A refrigerator door assembly includes a refrigerator door that has a recess and an alignment mechanism that includes a door hinge. A plate is fixedly attached to the door hinge and positioned at least partially within the recess of the refrigerator door. The plate includes an orienting member configured to extend along an axis of rotation of the door hinge and away from a body of the plate. The refrigerator door is movably positionable between at least a first position and a second position relative to the plate to permit adjustment of a location of the refrigerator door relative to the door hinge. The recess includes a track that slides against the plate in a linear path between the first and second positions of the refrigerator door.

13 Claims, 11 Drawing Sheets

(56) References Cited

U.S. PATENT DOCUMENTS

| | | | |
|---|---|---|---|
| 3,518,716 | A | 7/1970 | Larson |
| 3,608,129 | A | 9/1971 | Heyer et al. |
| 3,788,094 | A | 1/1974 | Benasutti et al. |
| 4,070,728 | A | 1/1978 | Herman |
| 4,115,901 | A | 9/1978 | Schmidt |
| 4,170,391 | A | 10/1979 | Bottger |
| 4,189,805 | A | 2/1980 | Brackus |
| 4,383,414 | A | 5/1983 | Beitner |
| 4,550,576 | A | 11/1985 | Tate, Jr. et al. |
| 4,609,234 | A | 9/1986 | Naniwa |
| 4,646,472 | A | 3/1987 | Sugawara |
| 4,690,468 | A | 9/1987 | Lau |
| 4,696,078 | A | 9/1987 | Stromquist |
| 4,774,740 | A | 10/1988 | Gidseg et al. |
| 4,787,121 | A | 11/1988 | Racenis et al. |
| 4,864,691 | A | 9/1989 | Gidseg et al. |
| 4,912,942 | A | 4/1990 | Katterhenry et al. |
| 4,914,781 | A | 4/1990 | Sokn et al. |
| 4,914,782 | A | 4/1990 | Rupprechter |
| 5,158,503 | A | 10/1992 | Mitchell |
| 5,253,433 | A | 10/1993 | Frey |
| 5,263,509 | A | 11/1993 | Cherry et al. |
| 5,265,954 | A | 11/1993 | Keil |
| 5,349,832 | A | 9/1994 | Johnson et al. |
| 5,419,640 | A | 5/1995 | Doering |
| 5,483,770 | A | 1/1996 | Marinoni |
| 5,872,808 | A | 2/1999 | Davidovici et al. |
| 5,975,663 | A | 11/1999 | Becker |
| 6,036,294 | A | 3/2000 | Banicevic et al. |
| 6,141,830 | A | 11/2000 | Shimooka |
| 6,308,376 | B1 | 10/2001 | Koshikawa |
| 6,568,035 | B2 | 5/2003 | Zetti |
| 7,322,209 | B2 | 1/2008 | Hwang et al. |
| 7,334,293 | B2 | 2/2008 | Erickson et al. |
| 7,406,749 | B2 | 8/2008 | Herper |
| 7,517,031 | B2 | 4/2009 | Laible |
| 7,520,578 | B2 | 4/2009 | Tarantik |
| 7,685,678 | B2 | 3/2010 | Moon et al. |
| 7,987,558 | B2 | 8/2011 | Beckmann et al. |
| 8,162,415 | B2 | 4/2012 | Hagele et al. |
| 8,162,421 | B2 | 4/2012 | Lim et al. |
| 8,197,019 | B2 | 6/2012 | Kim |
| 8,254,103 | B2 | 8/2012 | Park et al. |
| 8,307,502 | B2 | 11/2012 | Bonomie et al. |
| 8,491,070 | B2 | 7/2013 | Davis et al. |
| 8,499,577 | B2 | 8/2013 | Watson et al. |
| 8,506,026 | B2 | 8/2013 | Kim et al. |
| 8,511,768 | B2 | 8/2013 | Brachert |
| 8,650,712 | B2 | 2/2014 | Wach et al. |
| 8,720,008 | B2 | 5/2014 | Doge et al. |
| 8,752,921 | B2 | 6/2014 | Gorz et al. |
| 8,764,133 | B2 | 7/2014 | Park et al. |
| 8,925,344 | B2 | 1/2015 | Mitchell et al. |
| 9,052,135 | B2 | 6/2015 | Trulaske, Sr. |
| 9,115,928 | B2 | 8/2015 | Akalan et al. |
| 9,212,846 | B2 | 12/2015 | Lee et al. |
| 9,222,293 | B2 | 12/2015 | Jenkinson |
| 9,267,721 | B2 | 2/2016 | Hunter |
| 9,322,592 | B2 | 4/2016 | Kim et al. |
| 9,328,954 | B2 | 5/2016 | Kang et al. |
| 9,593,518 | B2 | 3/2017 | Downs et al. |
| 9,790,722 | B2 | 10/2017 | Sun et al. |
| 9,823,011 | B2 | 11/2017 | Kempte |
| 10,295,246 | B2 | 5/2019 | Heisswolf |
| 10,400,490 | B2 | 9/2019 | Jung |
| 10,480,228 | B2 | 11/2019 | Kim et al. |
| 10,982,475 | B2 * | 4/2021 | Iwata ..... E05D 7/04 |
| 11,248,407 | B2 * | 2/2022 | Azevedo ..... E05D 7/0423 |
| 2005/0262663 | A1 | 12/2005 | Lee |
| 2008/0120807 | A1 | 5/2008 | Heger |
| 2009/0077995 | A1 | 3/2009 | Ihle et al. |
| 2010/0033067 | A1 | 2/2010 | Kim et al. |
| 2012/0080991 | A1 | 4/2012 | Wilson |
| 2015/0059126 | A1 | 3/2015 | Dubina et al. |
| 2017/0003069 | A1 | 1/2017 | Moertl et al. |
| 2017/0130502 | A1 | 5/2017 | Collene |
| 2017/0191210 | A1 | 7/2017 | Jung et al. |
| 2017/0318965 | A1 | 11/2017 | Hawkins et al. |
| 2018/0031302 | A1 | 2/2018 | Park et al. |

FOREIGN PATENT DOCUMENTS

| | | | |
|---|---|---|---|
| FR | 2668180 | A1 | 4/1992 |
| JP | 2015204928 | A | 11/2015 |
| RU | 2448208 | C1 | 4/2012 |
| WO | 2003018945 | A1 | 3/2003 |
| WO | 2005056959 | A1 | 6/2005 |

* cited by examiner

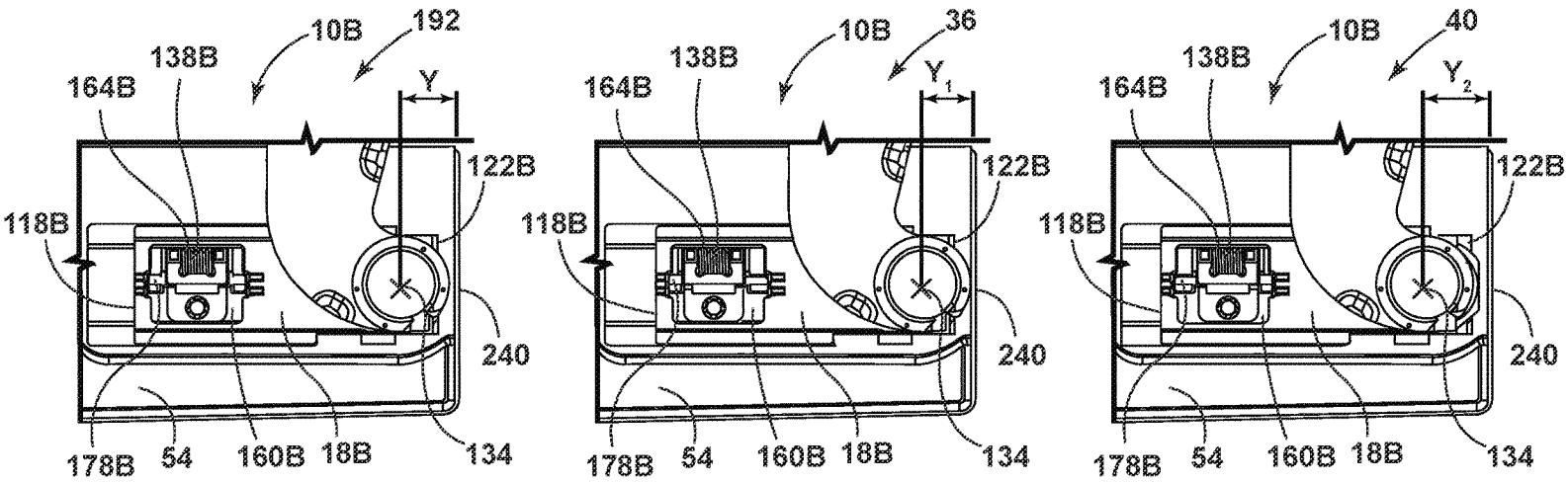
FIG. 17
FIG. 18
FIG. 19
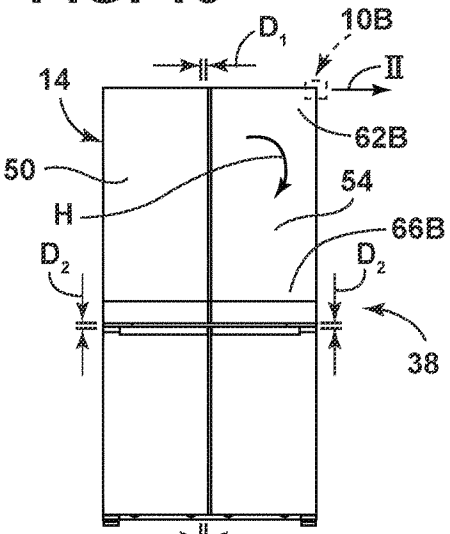
FIG. 19A
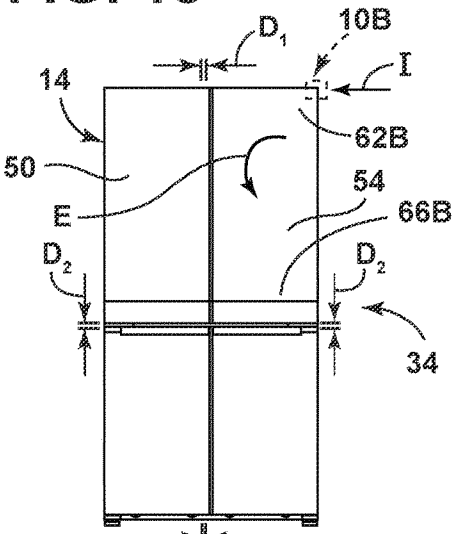
FIG. 18A
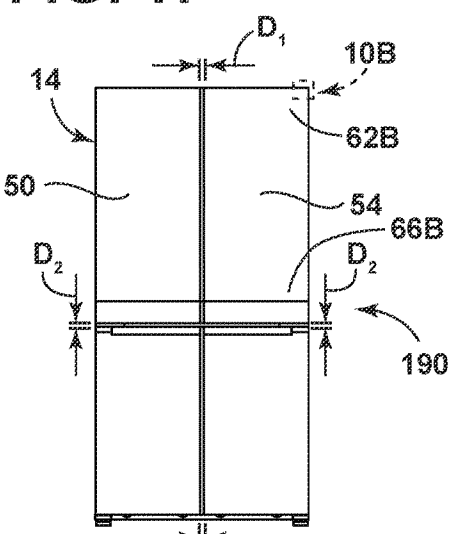
FIG. 17A

DOOR ALIGNMENT MECHANISM

CROSS-REFERENCE TO RELATED APPLICATIONS

This application claims priority to and is a division of U.S. Pat. No. 11,248,407 issued Feb. 15, 2022, entitled "DOOR ALIGNMENT MECHANISM," the disclosure of which is hereby incorporated herein by reference in its entirety.

BACKGROUND

An appliance may include multiple doors that may be aligned for a pleasing visual appearance of the appliance. It is therefore desirable for appliance doors to include alignment mechanisms for adjusting door positions.

SUMMARY

According to at least one aspect of the present disclosure, a refrigerator door assembly includes a refrigerator door that has a recess and an alignment mechanism that includes a door hinge. A plate is fixedly attached to the door hinge and positioned at least partially within the recess of the refrigerator door. The plate includes an orienting member configured to extend along an axis of rotation of the door hinge and away from a body of the plate. The refrigerator door is movably positionable between at least a first position and a second position relative to the plate to permit adjustment of a location of the refrigerator door relative to the door hinge. The recess includes a track that slides against the plate in a linear path between the first and second positions of the refrigerator door.

According to another aspect of the present disclosure, refrigerator door assembly includes a refrigerator door, a door hinge, a plate, and a translational coupling mechanism for securing the plate to the refrigerator door. The refrigerator door and the translational coupling mechanism are selectively movable in a first direction and a second direction relative to the plate to adjust a location of the refrigerator door relative to the door hinge. The plate is slidably disposed in a recess in the refrigerator door.

According to yet another aspect of the present disclosure, a refrigerator door assembly that has an adjustable alignment mechanism includes a door hinge. A mounting bracket is disposed proximate the door hinge and is fixedly coupled to the door hinge. The mounting bracket is configured to engage a refrigerator door that has an elongated slot in at least a first position, a second position, and a range of intermediate positions between the first position and the second position.

These and other features, advantages, and objects of the present device will be further understood and appreciated by those skilled in the art upon studying the following specification, claims, and appended drawings.

BRIEF DESCRIPTION OF THE DRAWINGS

In the drawings:

FIG. 17 is a top plan view of the door alignment mechanism of FIG. 14 with the movement element in an intermediate location;

FIG. 17A is a front elevational view of the refrigerator with the second top door in an intermediate position;

FIG. 18 is a top plan view of the door alignment mechanism of FIG. 14 with the movement element in a first location;

FIG. 18A is a front elevational view of the second top door in a first position;

FIG. 19 is a top plan view of the door alignment mechanism of FIG. 14 with the movement element in a second location; and FIG. 19A is a front elevational view of the second top door in a second position.

DETAILED DESCRIPTION

Figure 1:
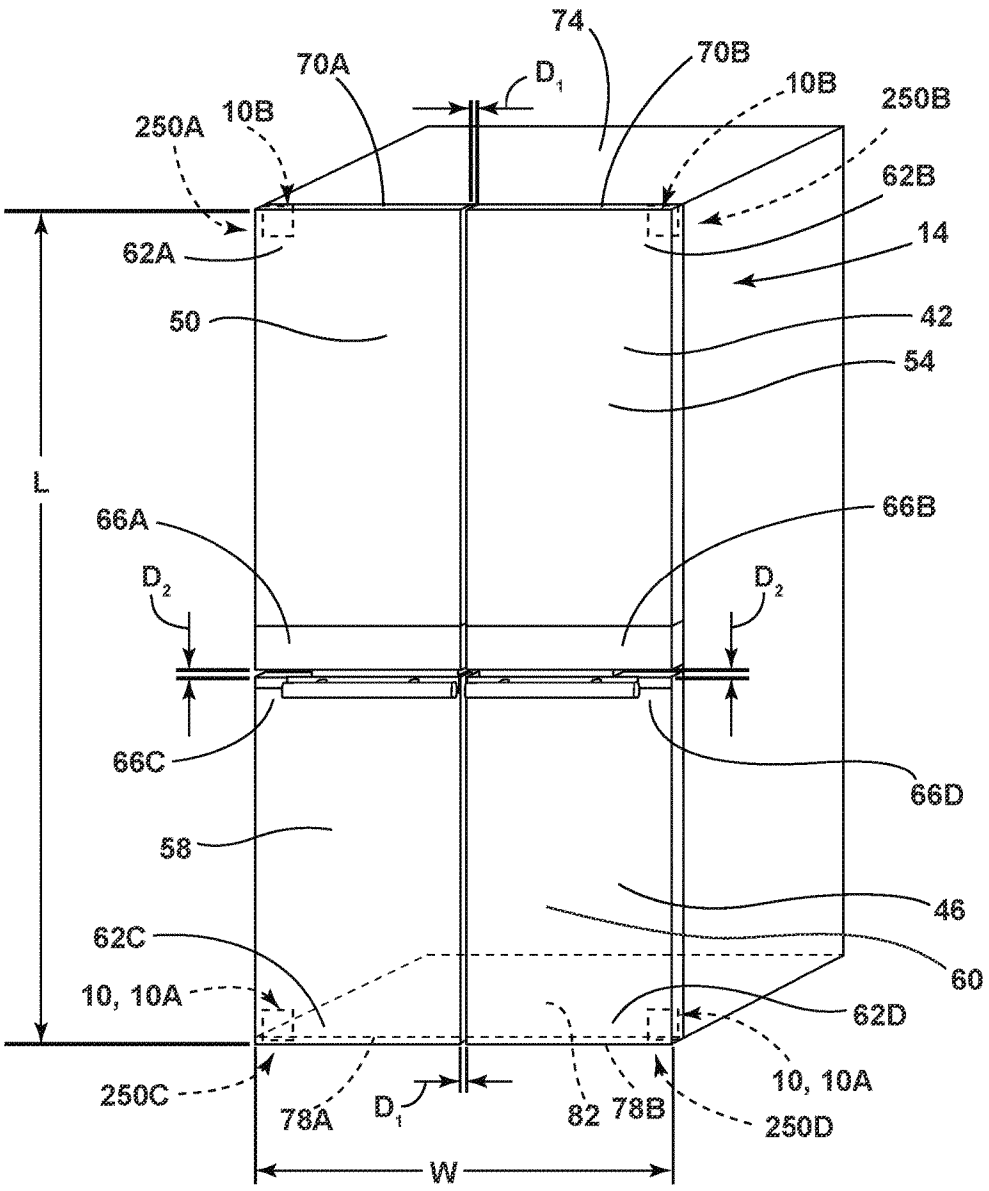
FIG. 1 is a front perspective view of a refrigerator.

For purposes of description herein the terms "upper," "lower," "right," "left," "rear," "front," "vertical," "horizontal," and derivatives thereof shall relate to the device as oriented in FIGS. 1-19A. However, it is to be understood that the device may assume various alternative orientations and step sequences, except where expressly specified to the contrary. It is also to be understood that the specific devices and processes illustrated in the attached drawings, and described in the following specification are simply exemplary aspects of the inventive concepts defined in the appended claims. Hence, specific dimensions and other physical characteristics relating to the aspects disclosed herein are not to be considered as limiting, unless the claims expressly state otherwise.

With reference to FIGS. 1-19A, various door alignment mechanisms 10, 10A, and 10B for a refrigerator 14 includes a plate 18, a door hinge 22, and a refrigerator door 26. The refrigerator door 26 has a recess 30. The plate 18 is fixedly attached to the door hinge 22 and positioned within the recess 30. The refrigerator door 26 is selectively and alternatively slidably positionable between a first position 34 and a second position 38, with respect to the plate 18, to adjust the location of the refrigerator door 26 with respect to the door hinge 22.

With reference to FIGS. 1-19A, a refrigerator door assembly 250 includes a refrigerator door 26 with a recess 30 and an alignment mechanism (also referred to as a door alignment mechanism 10, 10A, or 10B) that includes a plate 18 and a door hinge 22. The plate 18 is fixedly attached to the door hinge 22 and positioned at least partially within the recess 30 of the refrigerator door 26. The refrigerator door 26 is movably positionable between at least a first position 34 and a second position 38 relative to the plate 18 to permit adjustment of a location of the refrigerator door 26 relative to the door hinge 22.

Referring to FIG. 1, reference numeral 14 generally designates the refrigerator. FIG. 1 shows a refrigerator 14 of the French door top and French door bottom type. It is to be understood that this disclosure may apply to any type of refrigerator, for example, a side-by-side, two-door bottom mount, or a top-mount type refrigerator. Additionally, this disclosure may apply to a refrigerated appliance.

As shown in FIG. 1, the refrigerator 14 may have a refrigerated compartment 42 configured to refrigerate consumables and a freezer compartment 46 configured to freeze consumables during normal use. Accordingly, the refrigerated compartment 42 may be kept at a temperature above the freezing point of water and generally below a temperature of from about 35° F. to about 50° F., more typically below about 38° F., and the freezer compartment 46 may be kept at a temperature below the freezing point of water.

In some instances, the refrigerator 14 may have a cabinet and a liner within the cabinet to define the refrigerated compartment 42 and the freezer compartment 46. A mullion may separate the refrigerated compartment 42 and the freezer compartment 46. The refrigerator 14 may have one or more doors 26 that provide selective access into the interior volume of the refrigerator 14 where consumables may be stored. As shown, the refrigerator doors 26 may be designated as a first top refrigerator door 50, a second top refrigerator door 54, a first bottom refrigerator door 58, and a second bottom refrigerator door 60. It is appreciated that the refrigerator door configuration may be different than that which is illustrated in FIG. 1. In various aspects, a door alignment mechanism 10, 10A, 10B may be located at one or more of the locations designated in FIG. 1. Various door alignment mechanisms are disclosed herein, including door alignment mechanism 10 (FIGS. 2-7B), door alignment mechanism 10A (FIGS. 8-13A), and door alignment mechanism 10B (FIGS. 14-19A).

In some aspects, the first top refrigerator door 50 may have a first end 62A and a second end 66A. Similarly, the second top refrigerator door 54 may have a first end 62B and a second end 66B. The first bottom refrigerator door 58 may have a first end 62C and a second end 66C. The second bottom refrigerator door 60 may have a first end 62D and a second end 66D. A door alignment mechanism 10 may be disposed at a first end 62C and a first end 62D. In the depicted aspect, the second ends 66A, 66B, 66C, and 66D of the respective refrigerator doors 50, 54, 58, and 60 may be laterally fixed. In the depicted aspect, the door alignment mechanisms 10, 10A are disposed on lower surfaces 78A, 78B of respective bottom refrigerator doors 58, 60 proximate the lower surface 82 of the refrigerator 14. In the depicted aspect, the locations of the door alignment mechanism 10B may be upper surfaces 70A, 70B of respective top refrigerator doors 50, 54 proximate the upper surface 74 of the refrigerator 14. As such, the alignment mechanisms 10, 10A, 10B may be accessible to an individual who seeks to adjust the position of a refrigerator door 50, 54, 58, and 60.

Referring to FIG. 1, a refrigerator door assembly 250A, 250B, 250C, and 250D may be disposed at a respective end 62A, 62B, 62C, and 62D of a respective door 50, 54, 58, 60. The refrigerator door assembly 250A may contain at least a refrigerator door 50 and an alignment mechanism 10B. The refrigerator door assembly 250B may contain at least a refrigerator door 55 and an alignment mechanism 10B. The refrigerator door assembly 250C may contain at least a refrigerator door 58 and an alignment mechanism 10 or an alignment mechanism 10A. The refrigerator door assembly 250D may contain at least a refrigerator door 60 and an alignment mechanism 10 or an alignment mechanism 10A. Referring to FIGS. 1 and 14-19A, and with reference to the refrigerator door assembly 250B, the alignment mechanism (also referred to as a door alignment mechanism 10B), may include a plate 18B and a door hinge 22. Referring to FIGS. 1-8 and with reference to the refrigerator door assembly 250D, the alignment mechanism (also referred to as door alignment mechanism 10), may include a plate 18 and a door hinge 22. Referring to FIGS. 1 and 9-13A and with reference to the refrigerator door assembly 250D, the alignment mechanism (also referred to as door alignment mechanism 10A), may include a plate 18A and a door hinge. A movement element 138 may be disposed within the plate 18. A movement element 138A may be disposed within the plate 18A. A movement element 138B may be disposed between the plate 18B. In various aspects, the movement element 138 may be a translational coupling mechanism. In various aspects, the movement element 138A may be a translational coupling mechanism. In various aspects, the movement element 138B may be a translational coupling mechanism.

In various aspects, the door alignment mechanism 10 may be positioned at second ends 66A, 66B of the respective refrigerator doors 50, 54. In various aspects, the door alignment mechanism 10A may be positioned at second ends 66A, 66B of the respective refrigerator doors 50, 54. In various aspects, the door alignment mechanism 10B may be positioned at second ends 66C, 66D of the respective refrigerator doors 58, 60. Generally, it is convenient to adjust the position of a door 50, 54, 58, 60 when the door 50, 54, 58, 60 is in a closed or an almost closed position (instead of a fully open or substantially open position). In the closed or almost closed positions, the alignment of a door 26 is visible relative to other doors 26 on the refrigerator. As such, positioning of door alignment devices 10, 10A, at respective second ends 66A, 66B of refrigerator doors 50, 54 may involve different design considerations than positioning of door alignment devices 10, 10A at respective first ends 62C, 62D of refrigerator doors 58, 60. Positioning of door alignment device 10B at second ends 66C, 66D of refrigerator doors 58, 60 may involve different design considerations than positioning of door alignment device 10B at first end 62A, 62B of respective refrigerator doors 50, 54.

Visually appealing positioning of refrigerator doors 26 may be important to individuals who are shopping for a refrigerator 14 or individuals who own a refrigerator 14. Individuals may desire a refrigerator 14 with even spacing between refrigerator doors 26 in the closed position. As such, individuals may desire a refrigerator 14 with a substantially constant longitudinal gap $D_1$ between the first top refrigerator door 50 and the second top door 54 and a substantially constant longitudinal gap $D_1$ between the first bottom refrigerator door 58 and the second bottom refrigerator door 60. Similarly, individuals may desire a substantially constant lateral gap $D_2$ between the first top refrigerator door 50 and the first bottom refrigerator door 58 and a substantially constant lateral gap $D_2$ between the second top refrigerator door 54 and the second bottom refrigerator door 60. During the manufacturing process, a refrigerator 14 with doors that may not have constant longitudinal gaps $D_1$ and constant lateral gaps $D_2$ may be manufactured. In some situations, even when refrigerator 14 components are manufactured within manufacturing tolerances, a refrigerator 14 with doors that are not aligned in a visually appealing manner may be produced. That is, a refrigerator 14 lacking a generally constant longitudinal gap $D_1$ along the length L of the refrigerator 14 may be produced. Also, a refrigerator 14 lacking a generally constant latitudinal door gap $D_2$ along the width W of the refrigerator 14 may be produced. Thus, a device that allows for adjustment of the door 26 positions after manufacturing is desired. The door alignment mechanisms 10, 10A, 10B provide accessible, convenient adjustment of a door 26 position.

Referring now to FIGS. 2-19A, various aspects of the door alignment mechanisms 10, 10A, 10B are shown. An aspect of a door alignment mechanism 10 is shown in FIGS. 2-7B, an aspect of a door alignment mechanism 10A is shown in FIGS. 8-13A, and an aspect of a door alignment mechanism 10B is shown in FIGS. 14-19B. The first and second aspects 10 and 10A (FIGS. 2-7B and FIGS. 8-13A, respectively) are shown disposed at the lower surface 78B of a second bottom refrigerator door 60. The third aspect 10B (FIGS. 14-19B) is shown disposed at an upper surface 70B of a second top refrigerator door 54.

Figure 2:
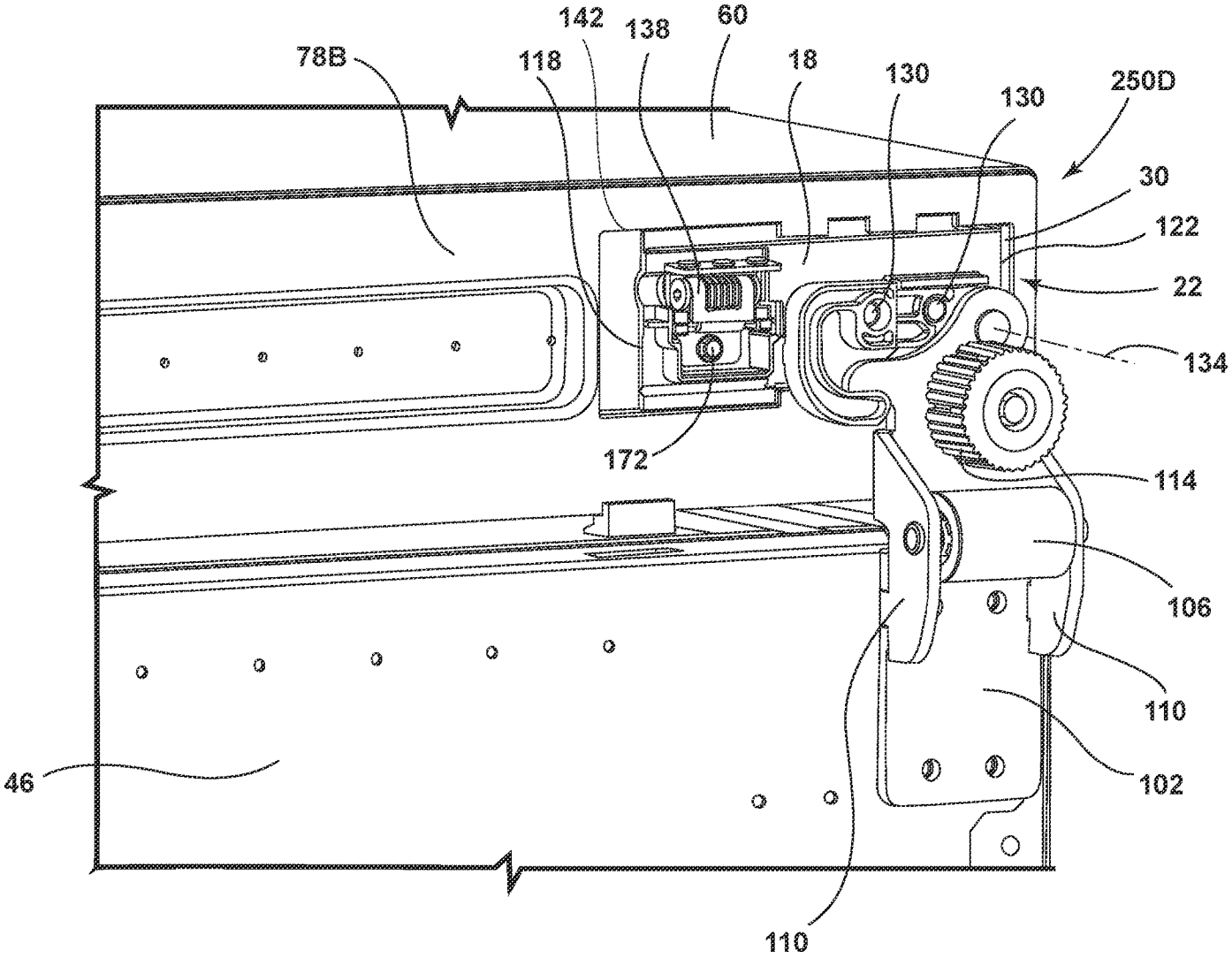
FIG. 2 is a bottom perspective view of a door alignment mechanism for an appliance.

Referring to FIG. 2, a door alignment mechanism 10 is disposed at the lower surface 78B of a second bottom refrigerator door 60. A bracket 102 may retain the second bottom refrigerator door 60 to provide access to the freezer compartment 46. A roller 106 may be mounted to flanges 110 that may extend from the bracket 102. A support (foot 114) may extend from the bracket 102. The support (foot 114) may be vertically adjustable to position the refrigerator 14 relative to the floor. A door hinge 22 may be disposed at the lower portion of the door 60.

With continued reference to FIG. 2, the lower surface 78B of the second bottom refrigerator door 60 may include a recess 30. A plate 18 may be disposed within the recess 30. The plate 18 may include a first edge 118 and a second edge 122. The first edge 118 may be distal from the door hinge 22. The second edge 122 may be proximate the door hinge 22. The plate 18 may be fixedly attached to the door hinge 22. Fasteners 130 may secure the plate 18 to the door hinge 22. The door hinge 22 may define an axis of rotation 134 of the door hinge 22 about which the second bottom refrigerator door 60 rotates between open and closed positions. As the door 60 rotates about the axis of rotation 134, the plate 18, being slidably attached to the door 60, also rotates with the door 60 about the axis of rotation 134. A movement element 138 may be disposed within the plate 18. The recess 30 may include a track 142 that may slide relative to and along the plate 18 in a linear path 144 (FIG. 4) when the second bottom refrigerator door 60 is moved. As such, a door alignment mechanism 10 is shown disposed in a lower surface 78B of a second bottom refrigerator door 60.

Figure 3:
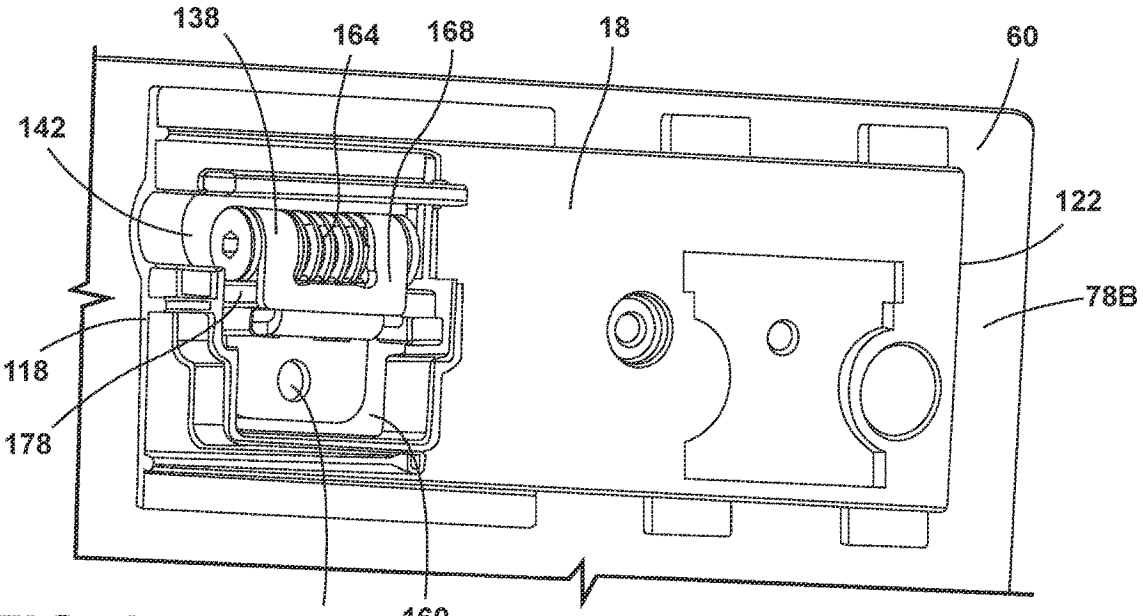
FIG. 3 is a bottom perspective view of a plate and movement element of the door alignment mechanism of FIG. 2.

Referring now to FIG. 3, the plate 18 may include an aperture 160 for receiving the movement element 138. In the depicted aspect, the movement element 138 may include a first portion and a second portion. The first portion may be fixed to a second bottom refrigerator door 60, and the second portion may be secured to a plate 18. In the aspect shown, the first portion may be a worm gear 164. The worm gear 164 may be fixedly retained in a cage 168. The cage 168 may be fastened to a lower surface 78B of the second bottom refrigerator door 60. A cage fastener 172 (FIG. 2) may be disposed through the cage hole 176 to secure the cage 168 to the lower surface 78B of the second bottom refrigerator door 60, typically within the track 142. The second portion may be a rack gear 178. The rack gear 178 may be secured to the plate 18. A rotational operation B, D, G (FIGS. 5B, 6B, 7B) of the worm gear 164 may translate the worm gear 164 relative to the rack gear 178. The rack gear 178 may span the aperture 160. The rack gear 178 may be fixedly attached to the plate 18. Thus, a rotational operation B, D, G (FIGS. 5B, 6B, 7B) of the worm gear 164 may move the second bottom refrigerator door 60 along a plate 18. In other words, rotation of the worm gear 164 causes a translation of the door 60 along the plate 18. The plate 18, in turn, slides within the track 142 to guide this movement of the door 60.

Figure 4:
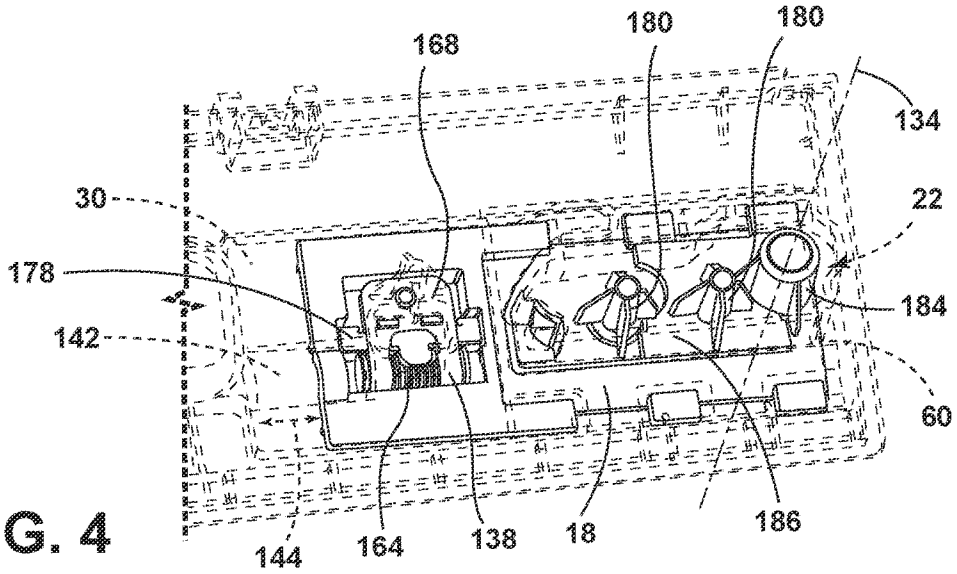
FIG. 4 shows a top perspective view of the plate and movement element of the door alignment mechanism of FIG. 2.

Referring now to FIG. 4, a top view of the plate 18 and movement element 138 in a second bottom refrigerator door 60 is shown. The plate 18 may include housings 180 for receiving fasteners 130 (FIG. 2) that attach the plate 18 to the second bottom refrigerator door 60 and an orienting member 184 that secures the plate 18 to the door hinge 22. The orienting member 184 may extend away from a body 186 of the plate 18. In the aspect shown, the orienting member 184 may be a cup-shaped protrusion. The movement element 138 may include the worm gear 164 and the rack gear 178. As previously explained, the recess 30 may include a track 142. The track 142 may facilitate movement of the second bottom refrigerator door 60 along the plate 18. The movement may be along a linear path 144.

With further reference to FIG. 4, the orienting member 184 is configured to extend along an axis of rotation 134 of a door hinge 22. In the aspect shown, the orienting member 184 may be disposed above and/or cover the door hinge 22. As shown, the cup-shaped orienting member 184 may shield the door hinge 22 from water that may leak from the refrigerator 14 and onto the door hinge 22.

Figure 7:
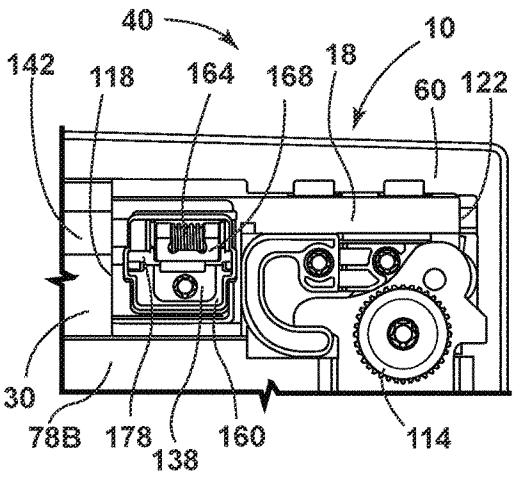
FIG. 7 is a bottom plan view of the door alignment mechanism of FIG. 2 with a movement element in a second location.
Figure 6:
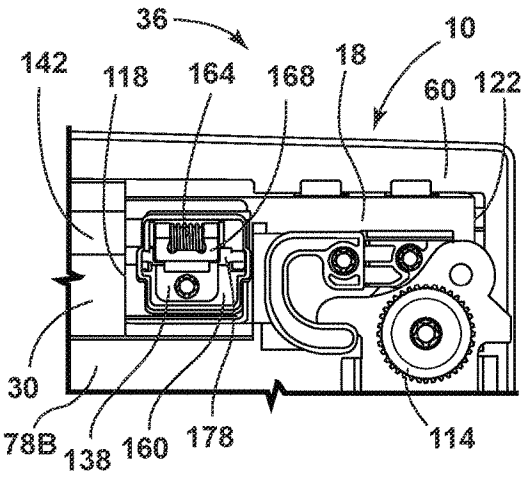
FIG. 6 is a bottom plan view of the door alignment mechanism of FIG. 2 with a movement element in a first location.
Figure 5:
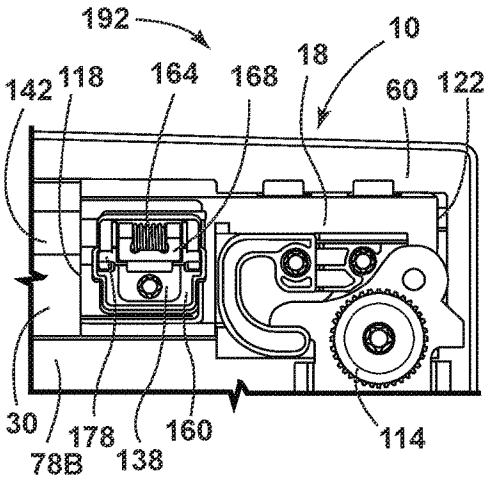
FIG. 5 is a bottom plan view of a door alignment mechanism of FIG. 2 with a movement element in an intermediate location.
Figure 7A:
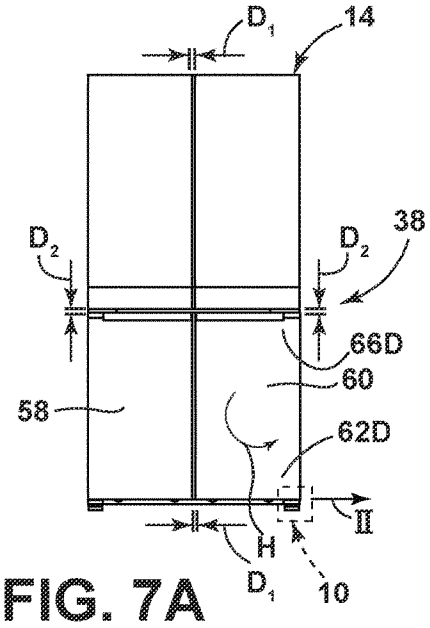
FIG. 7A is a front elevational view of a refrigerator with a second bottom door in a second position.
Figure 6A:
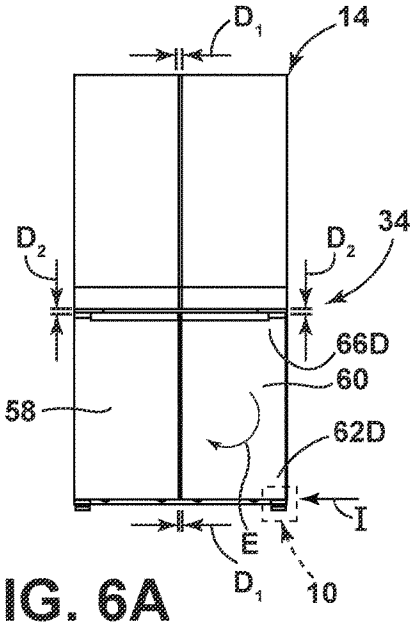
FIG. 6A is a front elevational view of a refrigerator with a second bottom door in a first position.
Figure 5A:
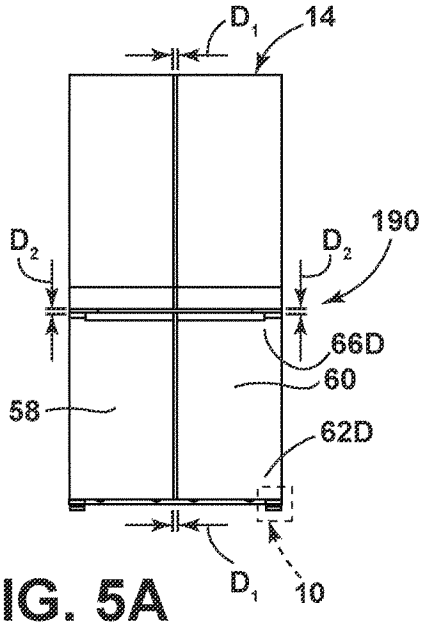
FIG. 5A is a front elevational view of a refrigerator with a second bottom door in an intermediate position.

Referring now to FIGS. 5-7B, the second bottom refrigerator door 60 and the movement element 138 are shown in various positions. FIGS. 5 and 5A show the movement element 138 in an intermediate location 192 and the second bottom refrigerator door 60 in an intermediate position 190. FIGS. 6-6A show the movement element 138 in a first location 36 and the second bottom refrigerator door 60 in a first position 34. FIGS. 7-7A show the movement element 138 in a second location 40 and the second bottom refrigerator door 60 in a second position 38.

As explained above and referring to FIGS. 5-5A, the movement element 138 is shown in the intermediate location 192, and the second bottom refrigerator door 60 is shown in the intermediate position 190. As shown in FIG. 5, the intermediate location 192 may include the movement element 138 centrally disposed in the aperture 160 in the plate 18.

Figure 5B:
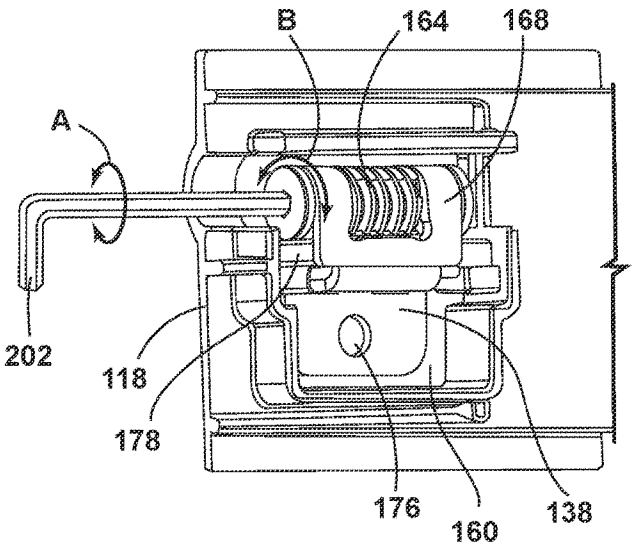
FIG. 5B is a bottom perspective view of a movement element with an actuator for operating the door alignment mechanism.

Referring to FIG. 5B, an actuator 202 for rotating a first portion of the movement element 138 (e.g., worm gear 164) is shown. The actuator 202 is rotatable in the directions shown by arrow A to rotate the worm gear 164 in the corresponding directions shown by arrow B. The actuator 202 may be an Allen wrench. In various aspects, the actuator 202 may be a manual actuator, a powered actuator, or other actuator.

Referring to FIGS. 6-6A, the movement element 138 is shown in a first location 36, and the second bottom refrigerator door 60 is shown in a first position 34. As shown in FIG. 6, the first location 36 may include the movement element 138 disposed at an end of aperture 160 that is close to first edge 118 of plate 18. Displacement of the second bottom refrigerator door 60 from the intermediate position 190 (FIG. 5A) to the first position 34 (FIG. 6A) includes movement of the second bottom refrigerator door 60 in the direction shown by arrow I. In various aspects, the second bottom refrigerator door 60 may be moved from the intermediate position 190 (FIG. 5A) to the first position 34 (FIG. 6A) in the direction shown by arrow I a distance within a range of from approximately 1.5 millimeters to approximately 6.0 millimeters.

Figure 6B:
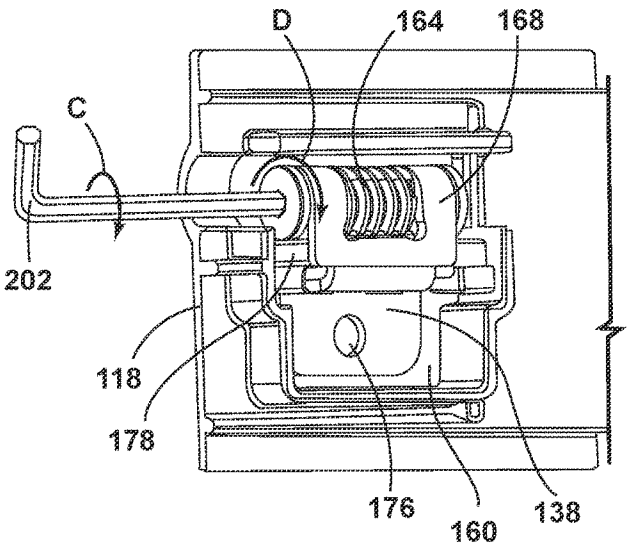
FIG. 6B is a bottom perspective view of a movement element with an actuator showing rotational operation of the door alignment mechanism.

With reference to FIG. 6B, the rotation of an actuator 202 in a first direction (arrow C) may cause the worm gear 164 to rotate (arrow D) to move the second bottom refrigerator door 60 to the first position 34. The rotational operation (arrow D) of the worm gear 164 may translate the worm gear 164 relative to the rack gear 178.

With reference again to FIGS. 6-6A, the first position 34 may be defined by movement of the movement element 138 of the lower surface 78B of the second bottom refrigerator door 60 toward the first edge 118 of the plate 18. Rotation of the first portion of the movement element 138 (e.g., worm gear 164) may cause the second bottom refrigerator door 60 to move in a first direction I (for example, toward the first position 34 or toward the first edge 118 of the plate 18). The track 142 of the recess 30 in the second bottom refrigerator door 60 may slide against the plate 18 to guide movement of the second bottom refrigerator door 60 in a linear path 144 (FIG. 4) when the second bottom refrigerator door 60 and the movement element 138 move in a first direction I.

With reference again to FIGS. 6-6A, when the movement element 138 is repositioned from an intermediate location 192 to a first location 36, a rotational movement E may occur about a laterally fixed second end 66D of the second bottom refrigerator door 60. That is, positioning of the second bottom refrigerator door 60 in a first position 34 may cause a rotational movement E in a first direction (arrow E) about the second end 66D of the second bottom refrigerator door 60. This rotational movement E is guided by a slidable engagement between the plate 18 and the track 142.

Referring to FIGS. 7-7A, the movement element 138 is shown in a second location 40, and the second bottom refrigerator door 60 is shown in a second position 38. As shown in FIG. 7, the second location 40 may include the movement element 138 disposed at the end of aperture 160 that is close to second edge 122 of plate 18. Displacement of the second bottom refrigerator door 60 from the intermediate position 190 (FIG. 5A) to the second position 38 (FIG. 7A) includes movement of the second bottom refrigerator door 60 in the direction shown by arrow II towards a second edge 122 of the plate 18. In various aspects, the second bottom refrigerator door 60 may be moved from the intermediate position 190 to the second position 38 in the direction shown by arrow II a distance in the range of from approximately 1.5 millimeters to approximately 6.0 millimeters.

Figure 7B:
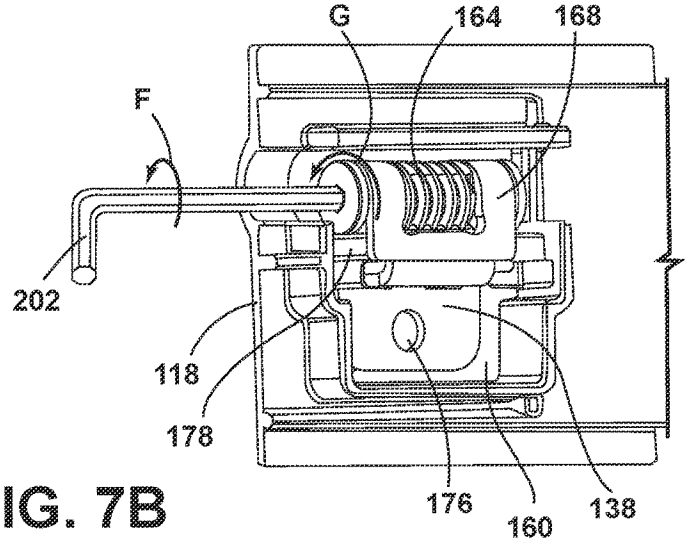
FIG. 7B is a bottom perspective view of a movement element with an actuator showing rotational operation of the door alignment mechanism.

With reference to FIG. 7B, an actuator 202 may rotate (arrow F) the worm gear 164 in a direction shown by arrow G to move the second bottom refrigerator door 60 in the direction of arrow II to the second position 38. As previously explained with reference to FIG. 6B, the rotational operation (arrow G) of the worm gear 164 may translate the worm gear 164 relative to the rack gear 178. An actuator 202 may be selectively engageable to rotate the first portion (e.g., worm gear 164) of the movement element 138.

It should be understood that operation of the door alignment mechanism 10 with respect to the second bottom refrigerator door 60 is also contemplated with respect to the first bottom refrigerator door 58 by manipulating a dedicated door alignment mechanism for the first bottom refrigerator door 58.

With continued reference to FIGS. 7-7A, the second position 38 may be defined by movement of the second bottom refrigerator door 60 toward the second edge 122 of the plate 18. Rotation (arrow G in FIG. 7B) of the first portion of the movement element 138 (e.g., worm gear 164) may cause the second bottom refrigerator door 60 to move in a second direction shown by arrow II (for example, toward the second position 38 or toward the second edge 122 of the plate 18). The track 142 of the recess 30 in the second bottom refrigerator door 60 may slide against the plate 18 in a linear path 144 (FIG. 4) when the second bottom refrigerator door 60 and the movement element 138 move in a second direction II.

With reference again to FIGS. 7-7A, when the movement element 138 is repositioned from an intermediate location 192 to a second location 40, a rotational movement (arrow H) may occur about a laterally fixed second end 66D of the second bottom refrigerator door 60. That is, positioning of the second bottom refrigerator door 60 in a second position 38 may cause a rotational movement H in a second direction (arrow H) about the laterally fixed second end 66D of the second bottom refrigerator door 60. Referring to FIG. 7A, displacement of the second bottom refrigerator door 60 from an intermediate position 190 to a second position 38, as shown by arrow II in FIG. 7A, may create a rotational movement H of the second bottom refrigerator door 60 about the laterally fixed second end 66D of the second bottom refrigerator door 60.

As such, the second bottom refrigerator door 60 may be moved in a first direction I or a second direction II to improve the longitudinal gap D1 adjacent the second bottom refrigerator door 60 and/or the lateral gap D2 adjacent the second bottom refrigerator door 60.

It should be understood that the slidable engagement between the plates 18, 18A, 18B and the track 142 is present within each of the respective door alignment mechanisms 10, 10A, 10B. The linear and rotational guidance provided by this engagement in adjusting the various doors 26 is also provided in each of the door alignment mechanisms 10, 10A, and 10B.

Referring now to FIGS. 8-13A, door alignment mechanism 10A disposed on a lower surface 78B of a second bottom refrigerator door 60 is shown.

Figure 8:
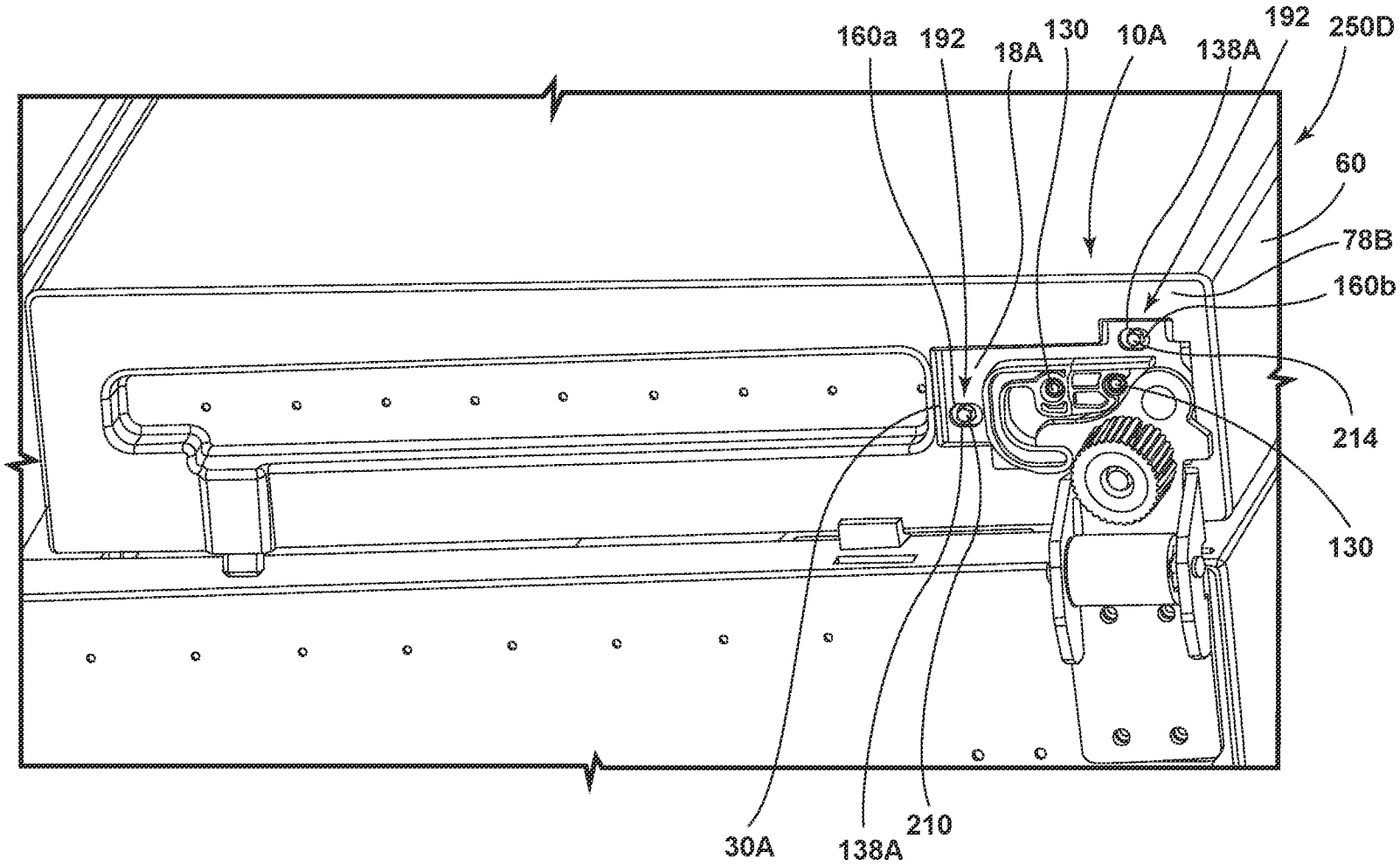
FIG. 8 is a bottom perspective view of a door alignment mechanism for an appliance.

With reference to FIG. 8, a plate 18A may be disposed in a recess 30A. The plate 18A includes a first aperture 160*a* and a second aperture 160*b*. The first aperture 160*a* may be referred to as a first cutaway portion. The second aperture 160*b* may be referred to as a second cutaway portion. A movement element 138A may be disposed in one or more of the first and second apertures 160*a* and 160*b*. The movement element 138A may include at least first and second fasteners 210, 214 disposed in the first and second apertures 160*a*, 160*b*, respectively.

With continuing reference to FIG. 8, first and second fasteners 210 and 214 are shown in an intermediate location 192. An intermediate location 192 may be defined by central disposition of the first and second fasteners 210 and 214 within the first and second apertures 160*a* and 160*b*, respectively. First and second fasteners 210 and 214 may be extendable into the second bottom refrigerator door 60 and selectively positionable within the respective first and second apertures 160*a*, 160*b* to position the second bottom refrigerator door 60 between the first position 34 and the second position 38 (FIGS. 12A and 13A).

Figure 9:
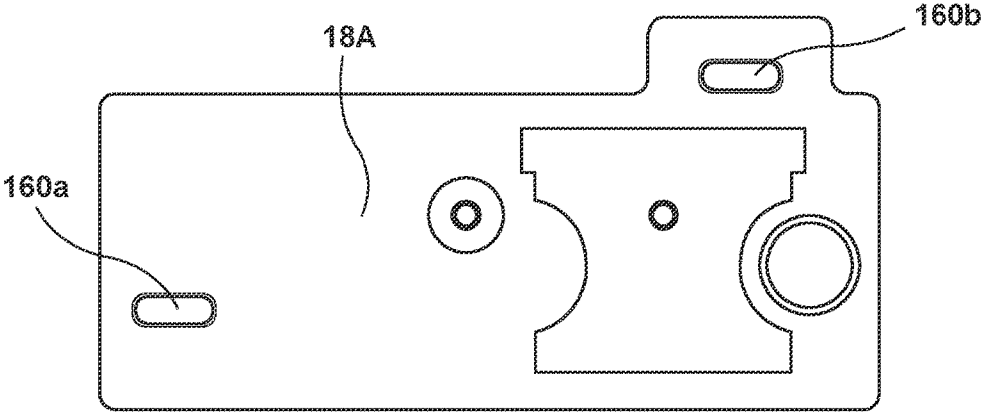
FIG. 9 is a bottom perspective view of a plate of the door alignment mechanism of FIG. 8.

FIG. 9 shows the plate 18A with the first and second apertures 160*a*, 160*b*. The first and second apertures 160*a*, 160*b* may be elongated to allow the second bottom refrigerator door 60 to slide between first and second positions 34, 38 relative to the plate 18A.

Figure 10:
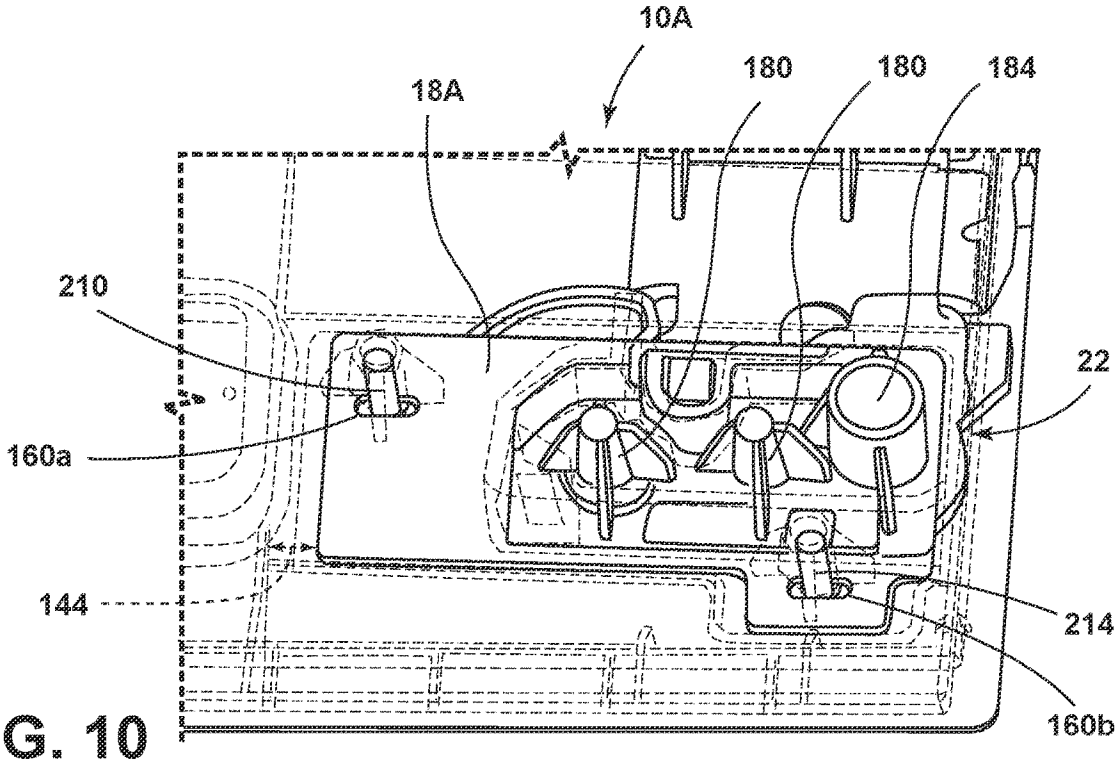
FIG. 10 is a top perspective view of the plate of the door alignment mechanism of FIG. 8.

With reference to FIG. 10, fastener housings 180 may receive fasteners 130 (FIG. 8) for fastening the plate 18A to the second bottom refrigerator door 60. Additionally, orienting member 184 may secure the plate 18A to the door hinge 22. The first fastener 210 and the second fastener 214 are shown centrally disposed in the first and second apertures 160*a*, 160*b*.

Figure 11:
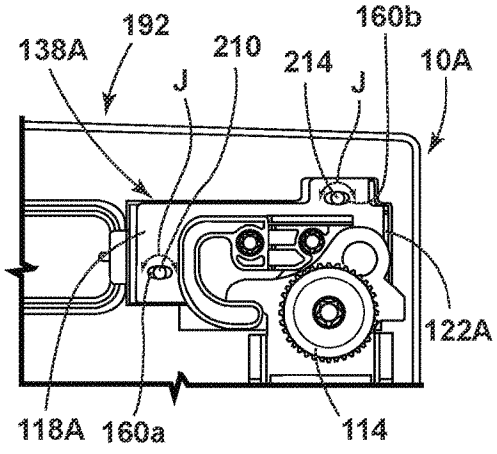
FIG. 11 is a bottom plan view of a door alignment mechanism of FIG. 8 with the movement element in an intermediate location.
Figure 11A:
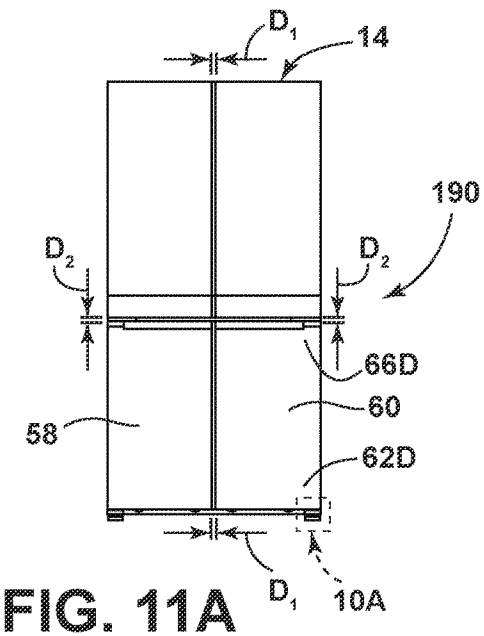
FIG. 11A is a front elevational view of the refrigerator with the second bottom door in an intermediate position.

With reference to FIGS. 11-11A, the movement element 138A is shown in an intermediate location 192, and the second bottom refrigerator door 60 is shown in the intermediate position 190. As previously stated, the movement element 138A may include at least the first fastener 210 and the second fastener 214 that are typically positioned within or proximate the track 142. The first and second fasteners 210, 214 may be rotatable in a clockwise direction shown by arrow J to tighten the fasteners 210, 214. The first and second fasteners 210, 214 may be rotated in a counterclockwise direction (also shown by arrow J) to loosen the first and second fasteners 210, 214. When the first and second fasteners 210, 214 are tightened, the track 142 of the second bottom refrigerator door 60 may be secured to the plate 18A. When the first and second fasteners 210, 214 are loosened, the second bottom refrigerator door 60 may be released from the plate 18A so that the track 142 defined within the second bottom refrigerator door 60 may slide along the plate 18A. In various aspects, the first and second fasteners 210, 214 remain connected to the second bottom refrigerator door 60 even when they are released from the plate 18A.

It should be understood that operation of the door alignment mechanisms 10 and 10A with respect to the second bottom refrigerator door 60 is also contemplated with respect to the first bottom refrigerator door 58 by manipulating a dedicated door alignment mechanism for the first bottom refrigerator door 58.

Figure 12:
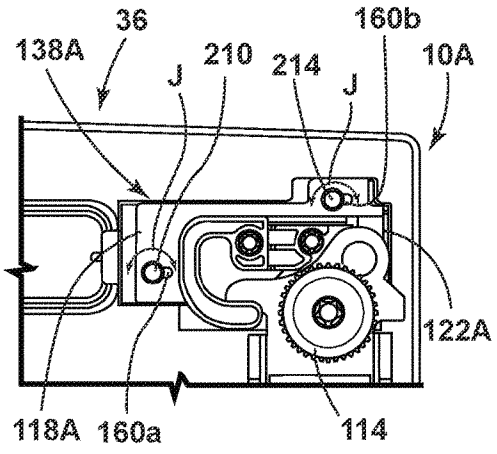
FIG. 12 is a bottom plan view of the door alignment mechanism of FIG. 8 with the movement element in a first location.
Figure 12A:
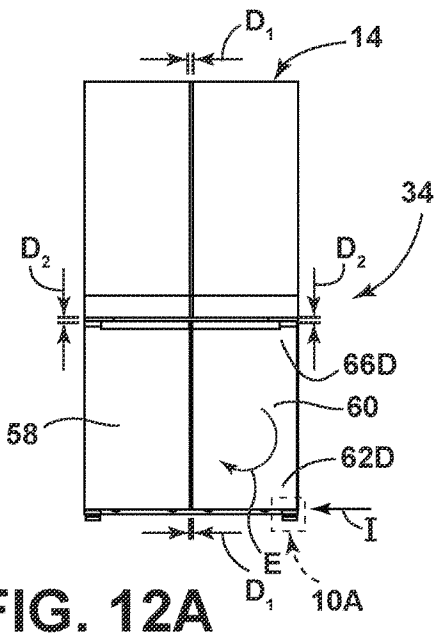
FIG. 12A is a front elevational view of the second bottom door in a first position.

FIGS. 12 and 12A show the movement element 138A in a first location 36 and the second bottom refrigerator door 60 in a first position 34. In various aspects, the second bottom refrigerator door 60 may be moved from the intermediate position 190 (FIG. 11A) to the first position 34 (FIG. 12A) in the direction shown by arrow I a distance within a range of from approximately 1.5 millimeters to approximately 6.0 millimeters.

Figure 13:
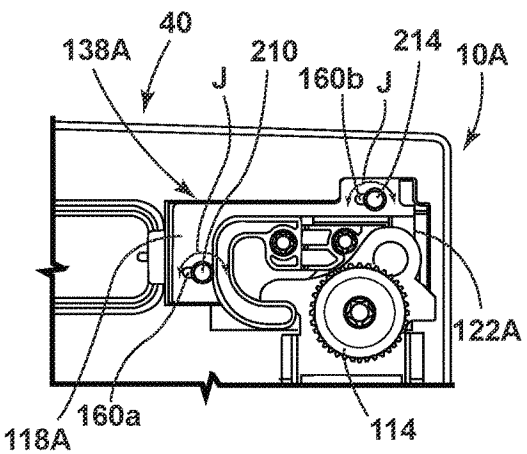
FIG. 13 is a bottom plan view of the door alignment mechanism of FIG. 8 with the movement element in a second location.
Figure 13A:
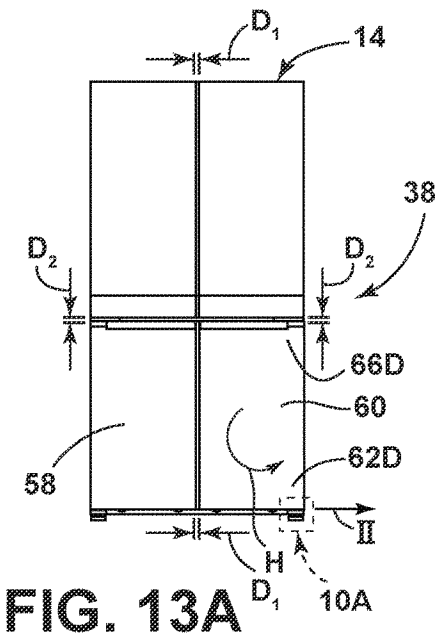
FIG. 13A is a front elevational view of the second bottom door in a second position.

FIGS. 13 and 13A show the movement element 138A in a second location 40 and the second bottom refrigerator door 60 in a second position 38. In various aspects, the second bottom refrigerator door 60 may be moved from the intermediate position 190 to the second position 38 in the direction shown by arrow II a distance in the range of approximately 1.5 millimeters to 6.0 millimeters.

In operation, for the second bottom refrigerator door 60 to move between the first position 34 and the second position 38, the first and second fasteners 210, 214 may be loosened while still engaged to the lower surface 78B of the second bottom refrigerator door 60. The second bottom refrigerator door 60 may be moved in a first direction I or a second direction II to improve the longitudinal gap D1 adjacent the second bottom refrigerator door 60 and/or the lateral gap D2 adjacent the second bottom refrigerator door 60. When the second bottom refrigerator door 60 is positioned in the desired position, the fasteners 210, 214 may be tightened to secure the second bottom refrigerator door 60 to the plate 18A. Again, the linear and rotational movements offered through operation of the door alignment mechanism 10A are guided by the slidable engagement between the plate 18A and the track 142.

As previously described with reference to door alignment mechanism 10, rotational movements E (FIG. 12A) and H (FIG. 13A) may occur around laterally fixed ends 66D of second bottom refrigerator door 60 during repositioning of second bottom refrigerator door 60.

Referring to FIGS. 14-19A, door alignment mechanism 10B is shown configured for attachment to an upper surface 70B of a second top refrigerator door 54. The door alignment mechanism 10B may be operationally similar to door alignment mechanism 10 (FIGS. 2-7B). The plate 18B of door alignment mechanism 10B may be configured for attachment to a door hinge 22 of a second top refrigerator door 54. As previously explained with regard to door alignment mechanism 10 shown in FIGS. 2-7B, a rotational operation B, D, G (FIGS. 5B, 6B, 7B) of the worm gear 164 may translate the worm gear 164 relative to the rack gear 178. Thus, a rotational operation B, D, G (FIGS. 5B, 6B, 7B) of the worm gear 164B may move the second top refrigerator door 54 along a plate 18B. This movement is guided by the track 142 within the second top refrigerator door 54.

Figure 14:
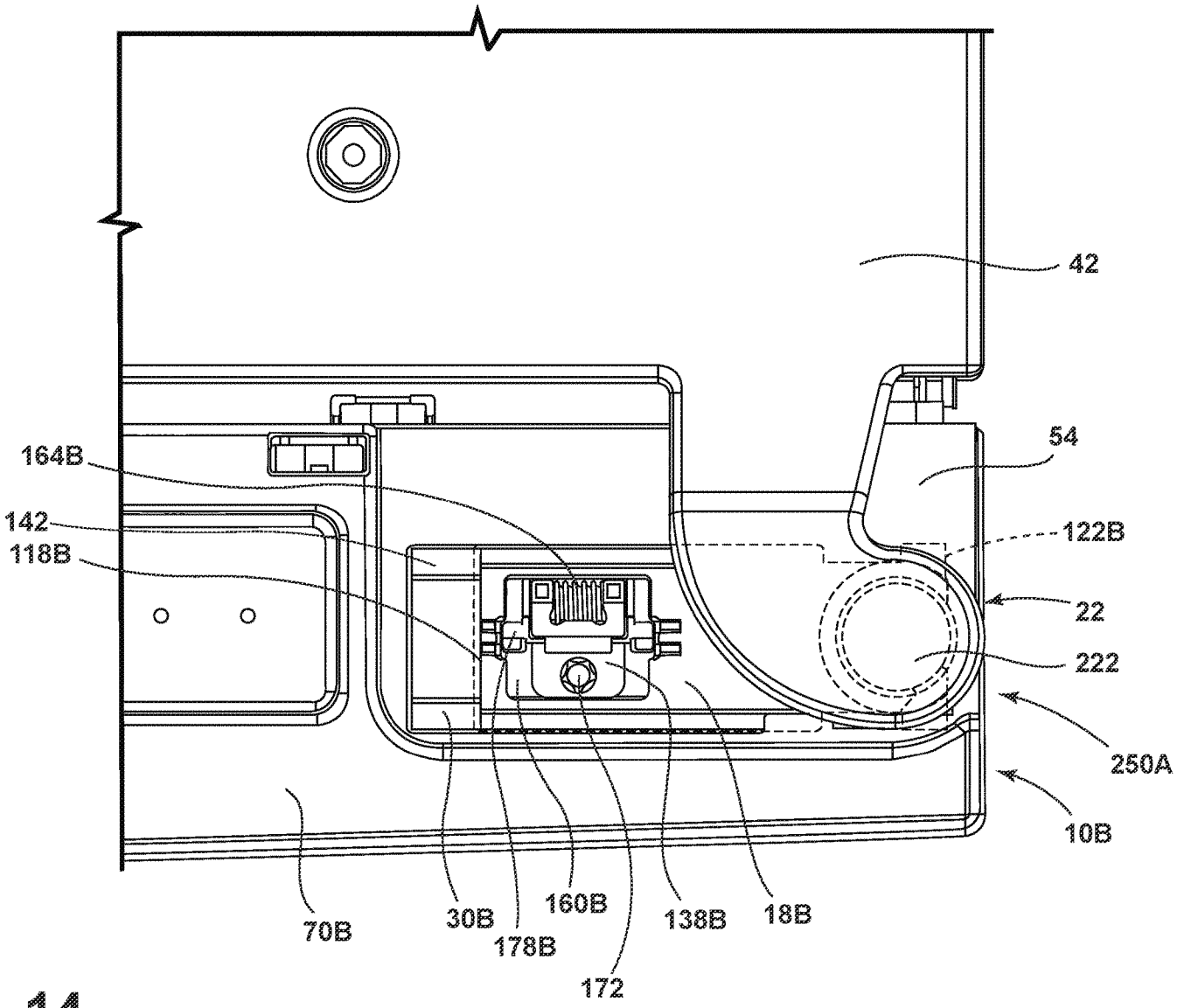
FIG. 14 is a top plan view of a door alignment mechanism positioned at a top of the appliance.

With reference to FIG. 14, the door alignment mechanism 10B disposed at the track 142 defined within the upper surface 70B of the second top refrigerator door 54 is shown. The plate 18B is shown disposed within recess 30B. The plate 18B includes a first edge 118B and a second edge 122B. The movement element 138B is shown in the aperture 160B of the plate 18B. The hinge cover 222 may be disposed over the area of the plate 18B proximate the second edge 122B of the plate 18B.

Figure 15:
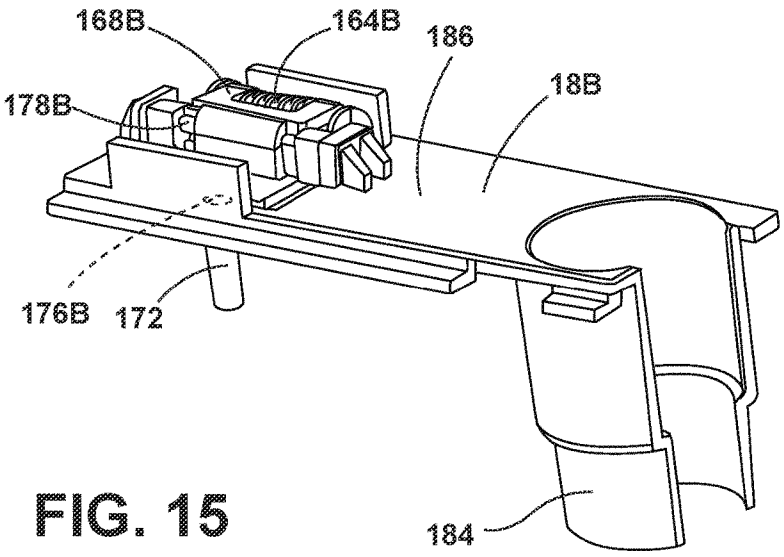
FIG. 15 is a top perspective view of the plate and the movement element of the door alignment mechanism of FIG. 14.

Referring to FIG. 15, the plate 18B may include an orienting member 184 extending away from a body 186 of the plate 18B. The orienting member 184 may at least partially surround a door hinge 22. The orienting member 184 may have a cuff-like shape. A cage fastener 172 is shown extended through a cage hole 176B. The cage fastener 172 may attach the cage 168B to the upper surface 70B of the second top refrigerator door 54.

Figure 16:
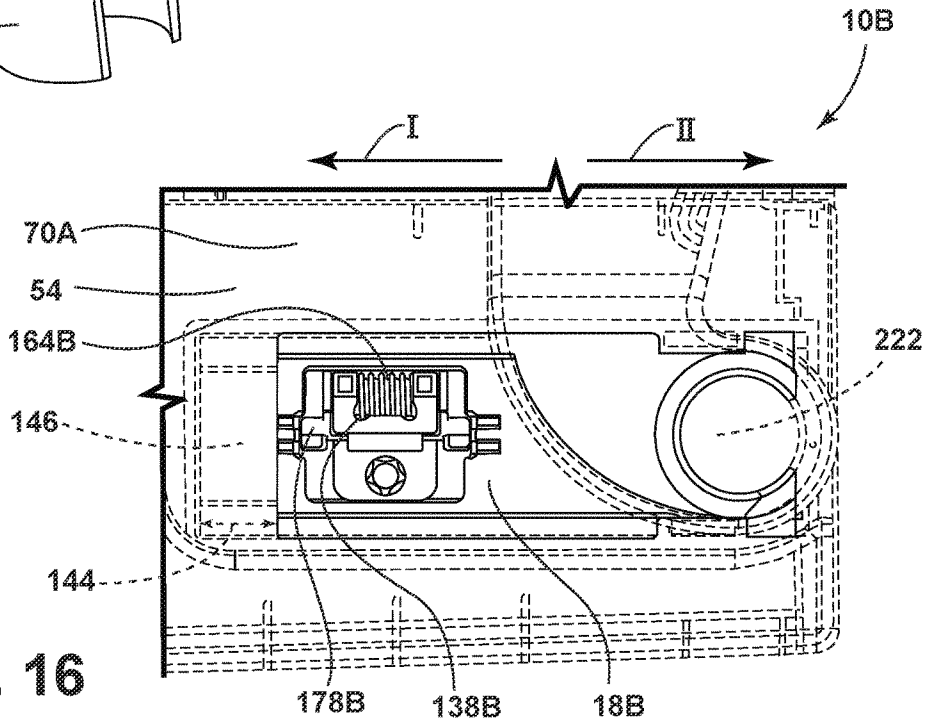
FIG. 16 is a bottom perspective view of the plate and the movement element of the door alignment mechanism of FIG. 14.

With reference to FIG. 16, a top view of the plate 18B and movement element 138B in the upper surface 70B of the second top refrigerator door 54 is shown.

Referring to FIGS. 17-17A, the movement element 138B is shown in an intermediate location 192, and the second top refrigerator door 54 is shown in an intermediate position 190. The intermediate location 192 may be defined by the movement element 138B in a centrally disposed position of the aperture 160B in the plate 18B. In one example, the distance Y (FIG. 17) between the axis of rotation 134 of the door hinge 22 and the side 240 of the second top refrigerator door 54 may be in the range of approximately 10.0 millimeters to approximately 43.0 millimeters.

Referring to FIGS. 18-18A, the movement element 138B is in a first location 36 and the second top refrigerator door 54 is in a first position 34. Displacement of the second top refrigerator door 54 from the intermediate position 190 to the first position 34 includes a guided movement of the second top refrigerator door 54 in the direction shown by arrow I within the track 142 and towards a first edge 118B of the plate 18B. In various aspects, the second top refrigerator door 54 may be moved from the intermediate position 190 (FIG. 17A) to the first position 34 (FIG. 18A) in the direction shown by arrow I a distance within a range of approximately 1.0 millimeters to approximately 4.0 millimeters and ideally approximately 2.0 millimeters. The distance Y1 (FIG. 18) between the axis of rotation 134 of the door hinge 22 and the side 240 of the second top refrigerator door 54 may change in response to the movement of the second top refrigerator door 54.

With continued reference to FIG. 18A, the second top refrigerator door 54 may include a first end 62B and a second end 66B. In the depicted aspect, the door alignment mechanism 10B may be disposed at the first end 62B of the second top refrigerator door 54. The second end 66B of the second top refrigerator door 54 may be laterally fixed. When the second top refrigerator door 54 is moved from the intermediate position 190 to the first position 34 in the direction shown by arrow I, then a rotational movement E may be created about the laterally fixed second end 66B of the second top refrigerator door 54.

Referring to FIGS. 19-19A, movement element 138B is in a second location 40 and the second top refrigerator door 54 is in a second position 38. Displacement of the second top refrigerator door 54 from the intermediate position 190 to the second position 38 includes movement of the second top refrigerator door 54 in the direction shown by arrow II towards a second edge 122B of the plate 18B. In various aspects, the second top refrigerator door 54 may be moved from the intermediate position 190 to the second position 38 in the direction shown by arrow II a distance within the range of approximately 1.5 millimeters to approximately 6.0 millimeters and ideally approximately 3.0 millimeters. The distance Y2 (FIG. 19) between the axis of rotation 134 of the door hinge 22 and the side 240 of the second top refrigerator door 54 may change in response to the movement of the second top refrigerator door 54.

With continued reference to FIG. 19A, when the second top refrigerator door 54 is moved from the intermediate position 190 (FIG. 17A) to the second position 38 (FIG. 19A) in the direction shown by arrow II then a rotational movement H may be created about the laterally fixed second end 66B of the second top refrigerator door 54.

It should be understood that operation of the door alignment mechanism 10B with respect to the second top refrigerator door 54 is also contemplated with respect to the first top refrigerator door 50 by manipulating a dedicated door alignment mechanism for the first top refrigerator door 50.

As such, the second top refrigerator door 54 may be moved in a first direction I or a second direction II to improve the longitudinal gap D1 adjacent to the second top refrigerator door 54 and/or the lateral gap D2 adjacent the second top refrigerator door 54.

With reference again to FIGS. 1-19A, in various aspects of the disclosure, an adjustable alignment mechanism (e.g., door alignment mechanism 10, 10A, or 10B) may include a door hinge 22 and a mounting bracket (e.g., respective plates 18, 18A, 18B) disposed proximate the door hinge 22 and fixedly coupled to the door hinge 22. The mounting bracket may be configured to engage a refrigerator door 50, 54, 58, or 60 having an elongated slot (e.g., a recess 30, 30A, or 30B) in at least a first position 34, a second position 38, and a range of other intermediate positions between the first position 34 and the second position 38.

A variety of advantages may be derived from use of the present disclosure. The door alignment mechanisms 10, 10A, 10B may allow adjustment of a door 26 while the door 26 is on a refrigerator 14. The door alignment mechanisms 10, 10A, 10B may allow adjustment of the door 26 to set the longitudinal and lateral gaps D1, D2 between refrigerator doors 26.

In each of the aspects of the door alignment mechanisms 10, 10A, 10B, the respective plate 18, 18A, 18B is slidably operable within the corresponding track 142. The plates 18, 18A, while axially and laterally fixed in relation to the hinge 22, are rotationally operable with the door 60 as it moves between open and closed positions. The plate 18B, while axially and laterally fixed in relation to the hinge 22, is rotationally operable with the door 54 as it moves between open and closed positions.

It will be understood by one having ordinary skill in the art that construction of the described device and other components is not limited to any specific material. Other exemplary aspects of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary aspects is illustrative only. Although only a few aspects of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary aspects without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated aspects only. Modifications of the device will occur to those skilled in the art and to those who make or use the device. Therefore, it is understood that the aspects shown in the drawings and described above are merely for illustrative purposes and not intended to limit the scope of the device, which is defined by the following claims as interpreted according to the principles of patent law, including the Doctrine of Equivalents.

What is claimed is:

1. A refrigerator door assembly comprising:

a refrigerator door having a recess;

an alignment mechanism including a door hinge and a plate that is fixedly attached to the door hinge; and the plate positioned at least partially within the recess of the refrigerator door, the plate including an orienting member configured to extend along an axis of rotation of the door hinge and away from a body of the plate, wherein the refrigerator door is movably positionable between at least first and second positions relative to the plate to permit adjustment of a location of the refrigerator door relative to the door hinge, and wherein the recess defines a track that the plate slides against in a linear path as the refrigerator door moves between the first and second positions;

wherein the alignment mechanism further includes a movement element disposed within the plate;

wherein the movement element includes a worm gear secured to the refrigerator door, wherein the worm gear is selectively rotatable to move the refrigerator door between the first and second positions; and wherein the movement element further comprises a rack gear secured to the plate and wherein a rotational operation of the worm gear translates the worm gear relative to the rack gear.

2. The refrigerator door assembly of claim 1, wherein the rotational operation of the worm gear translates the refrigerator door between the first position and the second position.

3. The refrigerator door assembly of claim 1, wherein the plate is disposed at a top of the refrigerator door, and wherein the orienting member at least partially surrounds the door hinge.

4. The refrigerator door assembly of claim 1, wherein the orienting member includes a cup shaped protrusion.

5. The refrigerator door assembly of claim 1, wherein the plate includes a cutaway portion defining the first and second positions of the refrigerator door.

6. The refrigerator door assembly of claim 5, wherein a fastener is extendable into the refrigerator door and positionable within the cutaway portion position, respectively the first position or the second position, respectively.

7. The refrigerator door assembly of claim 1, wherein the refrigerator door is in the first position when the refrigerator door is positioned adjacent a first edge of the plate and wherein the refrigerator door is in the second position when the refrigerator door is positioned adjacent a second edge of the plate.

8. A refrigerator door assembly comprising:

a refrigerator door having a recess;

a door hinge; and a plate that is fixedly attached to the door hinge and positioned at least partially within the recess of the refrigerator door, the plate including an orienting member configured to extend along an axis of rotation of the door hinge and away from a body of the plate, wherein the refrigerator door is movably positionable between at least first and second positions relative to the plate to permit adjustment of a location of the refrigerator door relative to the door hinge, and wherein the recess defines a track that the plate slides against in a linear path as the refrigerator door moves between the first and second positions;

wherein a movement element is disposed within the plate;

wherein the movement element includes a worm gear secured to the refrigerator door, wherein the worm gear is selectively rotatable to move the refrigerator door between the first and second positions;

wherein the movement element further comprises a rack gear secured to the plate and wherein a rotational operation of the worm gear translates the worm gear relative to the rack gear; and wherein the rotational operation of the worm gear translates the refrigerator door between said first position and said second position.

9. The refrigerator door assembly of claim 8, wherein the refrigerator door is in the first position when the refrigerator door is positioned adjacent a first edge of the plate and wherein the refrigerator is in the second position when the refrigerator door is positioned adjacent a second edge of the plate.

10. The refrigerator door assembly of claim 8, wherein the plate is disposed at a top of the refrigerator door, and wherein the orienting member at least partially surrounds the door hinge.

11. The refrigerator door assembly of claim 8, wherein the orienting member includes a cup shaped protrusion.

12. The refrigerator door assembly of claim 8, wherein the plate includes a cutaway portion defining the first and second positions of the refrigerator door.

13. The refrigerator door assembly of claim 12, wherein a fastener is extendable into the refrigerator door and positionable within the cutaway portion.

* * * * *